US006021549A

United States Patent [19]

Stummer

[11] Patent Number: 6,021,549

[45] Date of Patent: Feb. 8, 2000

[54] OPENER FOR FLAKY FIBROUS MATERIALS

[76] Inventor: Josof Stummer, Mandeler Weg 19, D-55595 Roxheim, Germany

[21] Appl. No.: 09/051,208

[22] PCT Filed: Sep. 26, 1996

[86] PCT No.: PCT/DE96/01856

§ 371 Date: Apr. 3, 1998

§ 102(e) Date: Apr. 3, 1998

[87] PCT Pub. No.: WO97/13014

PCT Pub. Date: Apr. 10, 1997

[30] Foreign Application Priority Data

Oct. 4, 1995 [DE] Germany ..... 195 36 883

[51] Int. Cl.[7] ..... D01G 9/06

[52] U.S. Cl. ..... 19/200

[58] Field of Search ..... 19/200, 202, 80 R, 19/97; 57/300, 301, 304

[56] References Cited

FOREIGN PATENT DOCUMENTS

| | | | |
|---|---|---|---|
| 311544 | 4/1989 | European Pat. Off. | 19/200 |
| 0572495 | 12/1993 | European Pat. Off. . | |
| 100033 | 3/1898 | Germany . | |
| 3333750 | 4/1985 | Germany . | |
| 9104369 U | 11/1991 | Germany . | |
| 2206024 | 9/1987 | Japan | 19/200 |
| 62-263329 | 11/1987 | Japan . | |
| 558071 | 10/1975 | Russian Federation | 19/200 |
| 903389 | 2/1982 | Russian Federation | 19/200 |
| 1682424 | 10/1991 | Russian Federation | 19/200 |
| 93-124778 | 4/1992 | U.S.S.R. . | |
| 278471 | 10/1927 | United Kingdom . | |
| 478760 | 1/1938 | United Kingdom . | |
| 996604 | 6/1965 | United Kingdom . | |
| 93/19232 | 9/1993 | WIPO . | |

*Primary Examiner*—Ismael Izaguirre

*Attorney, Agent, or Firm*—Venable; George H. Spencer; Robert Kinberg

[57] ABSTRACT

An opener for opening flaky fiber material comprising a driven opening disk having a first side and a second side and which rotates in a direction; a first plurality of spikes is mounted on the first side of the opening disk; a counter opening disk which has a circumference, a first side facing the opening disc and a second side, fixedly mounted parallel and opposite to the first side of the opening disk; a second plurality of spikes is mounted on the first side of the counter opening disk and is fitted so as to tilt at an angle in a direction of the opening disk and is arranged substantially radially in rows, and a drive mechanism for moving the angle of at least one row of the spikes on the counter opening disk back and forth in the rotational direction and counter to the rotational direction of the opening disk.

20 Claims, 8 Drawing Sheets

OPENER FOR FLAKY FIBROUS MATERIALS

BACKGROUND OF THE INVENTION

The invention concerns an opener for opening flaky fiber material, which opener is incorporated via a short feed pipe that can be admitted with a transporting air flow under suction pressure and charged with fiber flakes, as well as via a discharge pipe, into a pneumatic conveyor line for the processing of fiber material, said opener having a driven opening disk with spikes, to which is assigned a fixed counter opening disk, provided with radially outward extending rows of spikes in the direction of the opening disk spikes.

Various designs of such openers are known. Thus, the DE 33 33 750 A1, for example, discloses an opener for opening and cleaning of fiber material, which comprises two opposite arranged rollers, positioned parallel above grate rods, grids or the like and below a closed covering cap in a horizontal plane and provided with spikes or the like, wherein the intake and discharge openings are arranged such that the fiber material is fed in and discharged in a direction parallel to the rollers and by means of an air flow. Such openers operating with spiked rollers require a large amount of floor space, have a low degree of opening with a poor flow rate, and are subject to high wear and tear. In addition, there is the danger of lap formation on the rollers with subsequent blocking.

The GB-A-996 604 furthermore discloses a fiber opening and cleaning machine with a driven opening disk that is installed in a housing and a stationary counter opening disk, located on the opposite side, with a space in-between. A fan wheel sits on the drive shaft for the opening disk and is located opposite the central opening in the counter opening disk. The opening in the counter opening disk is connected to a material feed line via a cone-shaped section of pipe, which discharges from the top into the housing. The opening disk and the counter opening disk are surrounded peripherally by fixed grate rods, through which dust travels on the one hand in horizontal direction to a ring-shaped chamber located inside the housing, while opened fiber material travels on the other hand in vertical direction to a venting hood that is located on the top of the housing and is connected to a suction line.

The GB-A-478 760 furthermore discloses a Crighton opener with a housing erected on a floor level and having a reverse U-shaped design, which opener comprises on the inside, in the lower region of said housing, a shaft that is supported on the floor and has a a short feed pipe attached to its side. On its top, the shaft supports a cage that is enlarged away from it in a truncated-cone shape and consists of individual grate rods. Located above this cage is a driven opening device, designed as cross wheel and functioning as a beater, which is connected to a discharge/feed-in pipe and is designed to drive foreign matter downward, in the is direction of the floor. Exhaust nozzles, which allow the continuous suctioning out of lighter foreign matter, are assigned to the cage side, inside a chamber between cage and housing.

In addition, the EP 0 572 495 B1 discloses an opener of this type, comprising a housing with built-in opening disk, which is incorporated via a short feed pipe and a short discharge pipe into a pneumatic conveying line for the processing of fiber material. The short feed pipe that discharges into the bottom part of the housing turns into an open hollow cylinder extending into the cylindrical housing, which is connected to the short discharge pipe by forming a ring-shaped chamber. At a specific, parallel distance to the free front of the hollow cylinder, a driven opening disk is arranged, which covers this cylinder and which is provided with sharp spikes pointing in the direction of the hollow cylinder. A fixed, circular-segment shaped counter opening disk is inserted into the front of the hollow cylinder, which is provided with sharp spikes pointing in the direction of the opening disk. These counter opening disk spikes can be installed such that they are tilted in rotational direction of the opening disk. To be sure, this represents a considerable improvement in the degree of opening for the flaky fiber material, but the inflexible opener of the spikes on the rotating opening disk as well as on the fixed counter opening disk nevertheless involves the danger of fiber flakes getting caught in the spikes and a lap formation on the spikes, which in extreme cases will clog the rows of spikes and will impede or even prevent the opening of the succeeding flaky fiber material. In that case, the machine must be stopped and the rows of spikes must be freed of fiber material wound around them.

DISCLOSURE OF THE INVENTION

It is therefore the object of the present invention to create an opener of the aforementioned type, which further improves the effectiveness of the known machines and which prevents in all cases the occurrence of fibers being caught in the opening region.

This object is solved in accordance with the invention in that the angle of at least one row of spikes on the counter opening disk can be adjusted continuously via a drive such that they tilt back and forth in rotational direction or counter to the rotational direction of the opening disk.

The essential advantages obtained with the opener according to the invention consist of an excellent degree of opening and a high capacity. The fiber air flow entering the short feed pipe passes through the hollow cylinder and exits from its open front where it is intercepted by the opening disk, operating at a relatively high speed, wherein the flaky fiber material is opened by the spikes on the opening disk and, as a result of the centrifugal force and together with the air, is guided through the peripheral discharge slot between opening disk and hollow cylinder and into the ring-shaped chamber. From there, the fiber air flow is then suctioned off via the short discharge pipe. The circular-segment shaped counter opening disk according to the invention, so-to-speak causes a combing of the flaky fiber material, without making it possible for the fibers to adhere to the spikes. These are constantly stripped off as a result of the permanent change in the angle of the spikes tilting back and forth, so that a lap formation of the fiber material on the opening disk is reliably prevented. As a result of this, such fiber-opening machines reach a high degree of efficiency not reached so far and have a correspondingly higher capacity.

In order to increase the efficiency of the rotating opening disk, one advantageous embodiment of the invention provides that the counter opening disk has a circular-segment shape, and that the first row of the spikes is arranged in rotational direction of the opening disk, behind the circular-segment shaped cutout in the counter opening disk, wherein the row of spikes extends crosswise to the rotational direction of the opening disk.

In a further embodiment according to the invention, several of the rows of spikes extend radially outward from the center point in the counter opening disk and form a ballistic curve, where the number of spikes in the rows decreases in rotational direction of the opening disk. This results in a saving of components, since the capacity required to open the flaky fiber material decreases in rotational direction of the opening disk, owing to the centrifugal force created by the fiber air flow, but is higher at the outer circumference of the counter opening disk than in the center region of the counter opening disk.

The degree of effectiveness of the process of opening the flaky fiber material can be increased further in that two parallel, side-by-side extending rows of spikes are arranged on the counter opening disk, for which the angle can be adjusted continuously to move back and forth in counter direction to each other or in the same direction. As a result of this, the opening effect on the fiber material is nearly doubled, so-to-speak, since this material passes the rows of spikes twice, which rows can tilt back and forth. The spikes moving back and forth are mounted on a rotatable shaft to achieve the angle adjustment.

In addition, it can be provided that respectively at least one row of fixed spikes is arranged between neighboring, parallel and side-by-side extending rows of spikes, for which the angle can be adjusted continuously back and forth. This may be advisable if sufficient space exists between the two rows of spikes that are tilting back and forth to have a row of rigidly secured spikes on the counter opening disk. If necessary, the spikes in the rigidly secured row of spikes on the counter opening disk can be installed such that they are tilted in rotational direction of the opening disk in order to support the effect of opening the flaky fiber material.

The circular-segment shaped cutout in the counter opening disk is defined by a circumferential angle $\alpha$ of approximately 120° to achieve an optimum suction effect in the transport flow of the fiber material.

In order to improve the opening effect, one advantageous embodiment of the subject according to the invention provides that the counter opening disk has spikes only over an angular region $\beta$ of approximately 120°. As previously explained, it makes sense if the pointy spikes in that case are arranged in a ballistic curve on the counter opening disk.

For an easier installation of the rows of spikes, at least the rows of spikes that can be moved back and forth to change the angle are mounted in an insert, which can be fitted into a corresponding recess in the counter opening disk. With this embodiment, it is possible to provide the insert with a lip seal in the direction of the opening disk, which seals the shaft studded with the spikes to prevent the fiber material from exiting between the opening disk and the counter opening disk. This prevents fine fibers from clogging the shafts studded with spikes. It makes sense to design the spikes extending into the fiber material discharge such that they are pointed.

In a special embodiment of the invention, the rows of spikes that can be adjusted back and forth to change the angle are advantageously actuated by a motor-operated crank mechanism. For this, the crank mechanism is provided with an eccentric cam, which transmits the drive movement to the respective connecting rod for the crank mechanism. The motor for the crank mechanism can in this case be an electric motor, a pneumatic motor or a hydraulic motor.

An alternative solution for the problem underlying the invention distinguishes itself in that at least one row of the spikes on the counter opening disk is positioned such that the angle can be adjusted in rotational direction and counter to the rotational direction of the opening disk, wherein a spring acts upon the spikes in the rotational direction of the opening disk. The spikes clean themselves as a result of this measure. If too much fiber material is wrapped around the spikes, the spikes move in the direction counter to the spring action and occupy a position counter to the rotational direction of the opening disk, as a result of which the spikes are freed of the fiber material. It makes sense if a tension spring or a compression spring is assigned to each row of spikes for which the angle can be adjusted. It is preferable if the tension spring or the compression spring is a steel spring or a rubber spring.

Another alternative solution to the invention is that at least one spike on the counter opening disk is held spring-mounted and tilted in rotational direction of the opening disk. As a result of this measure, the spike wrapped with too much fiber material will tilt counter to its spring-admission, thereby freeing the spike of the fibrous material wrapped around it when the opener is operated. Thus, a virtual self-cleaning of the spike occurs. It is preferable if each spike of at least one row of spikes on the counter opening disk is formed by the free front end of a spiral spring, wherein the angle of each spike can be adjusted in rotational direction and counter to the rotational direction of the opening disk and is held spring-loaded in the rotational direction of the opening disk.

BRIEF DESCRIPTION OF THE DRAWINGS

The idea upon which the invention is based is explained in further detail in the following description and with the aid of embodiments shown in the drawings. Shown are in.

DESCRIPTION OF THE PREFERRED EMBODIMENTS

Figure 1:
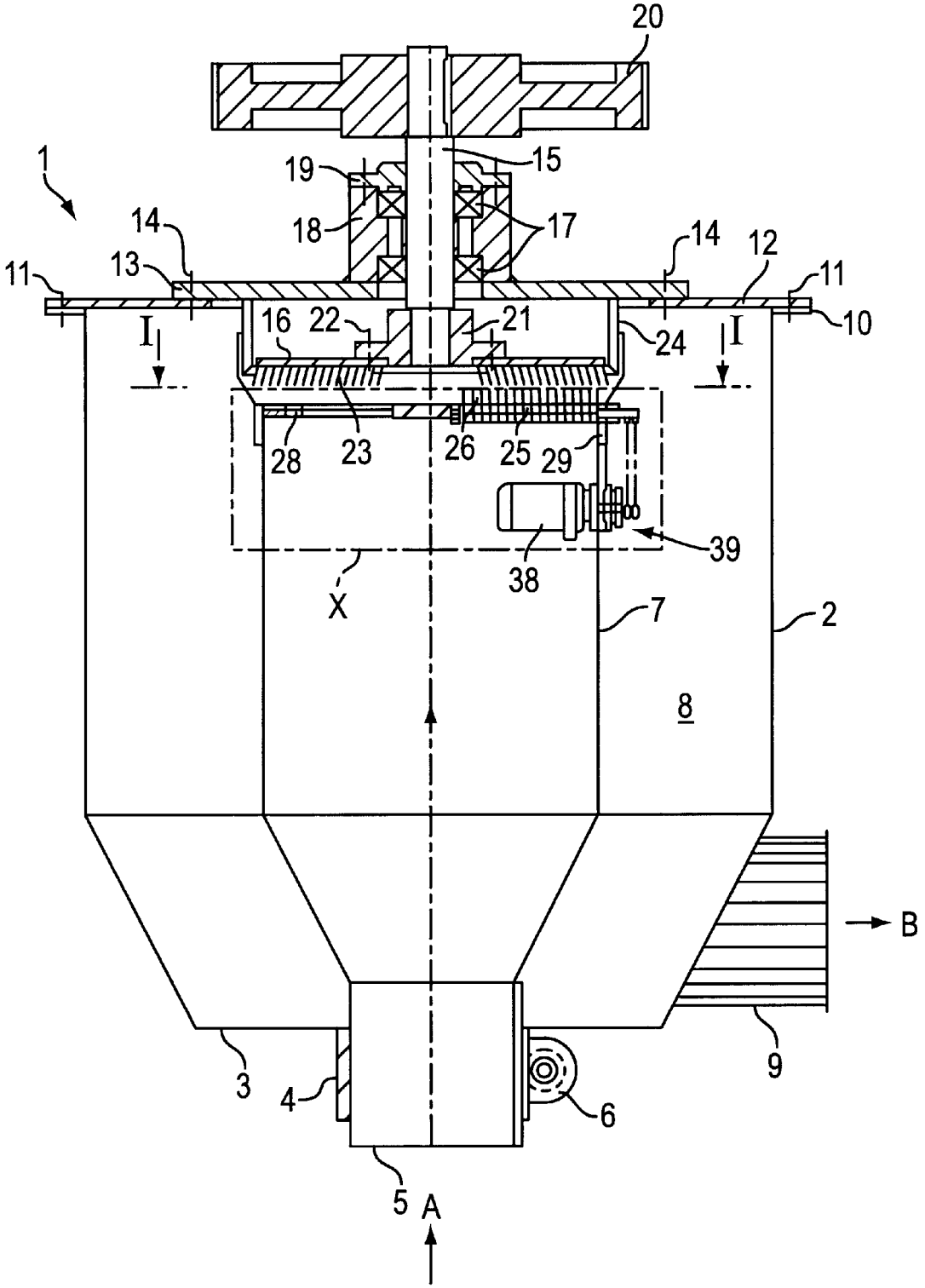
FIG. 1 A longitudinal section through an opener according to the invention.
Figure 2:
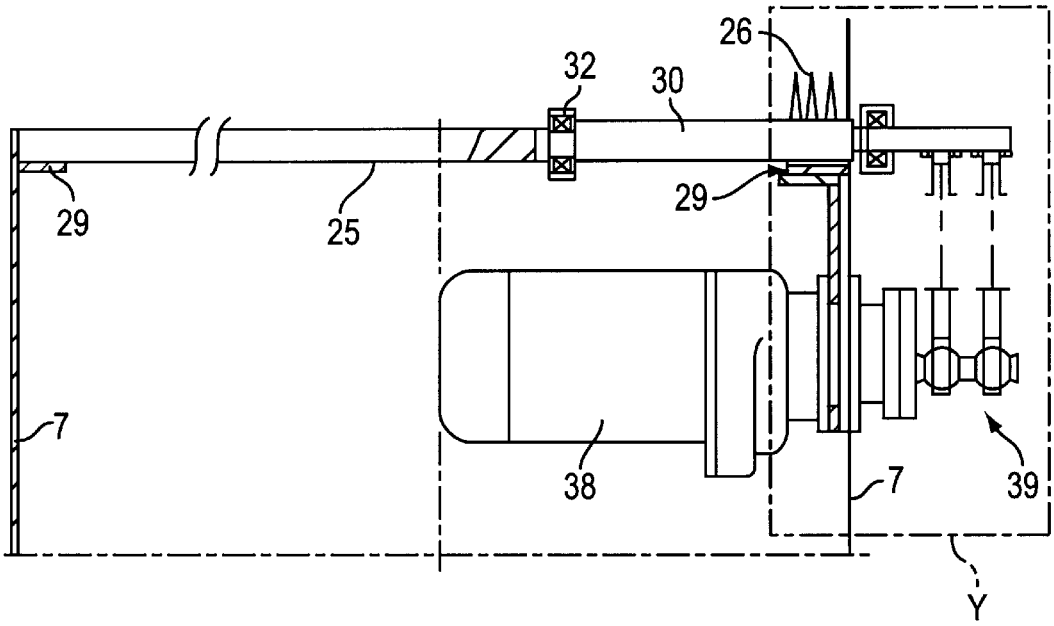
FIG. 2 An enlarged view of the detail "X" according to FIG. 1.

The opener 1 comprises a cylindrical housing 2 with a lower region that is designed to extend conically tapered toward the base 3 of housing 2. A ring flange 4 with a short feed pipe 5 that extends into the housing 2 such that it can be moved through sliding is located in the center of the outside of base 3 for housing 2. The short feed pipe 5 is held in its changeable position within the ring flange 4 by a connected cogwheel mechanism 6. A transport air flow under suction pressure, which is charged with fibrous flakes, flows from a machine supplying fibrous flakes is in the direction of arrow A through the short feed pipe 5 and into the opener 1.

Inside housing 2, the short feed pipe 5 is connected to a hollow cylinder 7, wherein the lower region of the hollow cylinder 7 is designed to expand in a truncated-cone shape outward from the short feed pipe 5. The parallel extending walls of the hollow cylinder 7 and the housing 2 form an annular chamber 8 between them, from which a short discharge pipe 9 extends outward in the lower region. A short fresh-air feed pipe, which is not shown and is located opposite the short discharge pipe 9, furthermore discharges into the lower region of the ring chamber 8. This allows fresh air to flow into the ring chamber 8, which avoids fiber deposits. Connected to the short discharge pipe 9 is a suction feed line, not shown here, for a ventilator that suctions off the fiber air flow in the direction of arrow B.

A circular ring flange 10 is provided on the upper outside end of housing 2, which is connected via screws 11 that are distributed evenly over the circumference to a circular cover disk 12. The opening 15 of the circular cover disk 12 is closed off by a lid 13 resting on it. The position of lid 13 is secured with screw connections 14 that are distributed evenly over the circumference. A drive shaft 15 for an opening disk 16 inside the housing 2 extends through the center of the lid 13.

The drive shaft 15 is supported on a bearing 17, held inside a bearing block 18 with associated bearing cover 19, which is attached to the outside of lid 13. A drive wheel 20 is attached so as to rotate along to the end of drive shaft 15, which projects over the bearing cover 19 of bearing block 19 [sic], which drive wheel can be linked with gears to a drive motor. A holding flange 21 for opening disk 16 is attached so as to rotate along to the end of drive shaft 15, which extends into the housing 2. The holding flange 21 that is fixedly attached to the drive shaft 15 is connected with screw connections 22 to the opening disk 16.

The opening disk 16 has a slightly larger diameter than the diameter of the hollow cylinder 7 and is fitted with pointed spikes 23 on the side facing the hollow cylinder 7, which spikes extend at an angle toward the outside. A ring flange 24 that is attached to the inside of lid 13 concentrically surrounds the opening disk 16.

The free front end of hollow cylinder 7, which is arranged coaxially to the opening disk 16, ends at a certain parallel distance to the opening disk 16, wherein this distance can be varied with the aid of the cogwheel mechanism 6, in dependence on the type of fiber air flow, to achieve an optimum degree of opening for the fiber material. Located opposite the opening disk 16 is a circular segment-shaped counter opening disk 25, which is fitted into the front of hollow cylinder 7 and which is provided according to FIG. 7 with pointed spikes 26, at least over an angular region $\beta$ of approximately 120°. The counter opening disk 25 furthermore has a circular segment-shaped cutout 27, which is defined by a circumferential angle $\alpha$ of approximately 120°. The counter opening disk 25 thus closes off more than half of the front of hollow cylinder 7. The resulting, reduced discharge opening 28 of hollow cylinder 7 guides the fiber air flow in a compressed form to the opening disk 16, which opens the fiber material in a joint action with the counter opening disk 25. The counter opening disk 25 is rigidly secured to the wall of hollow cylinder 7 by means of a flange 29.

Figure 3:
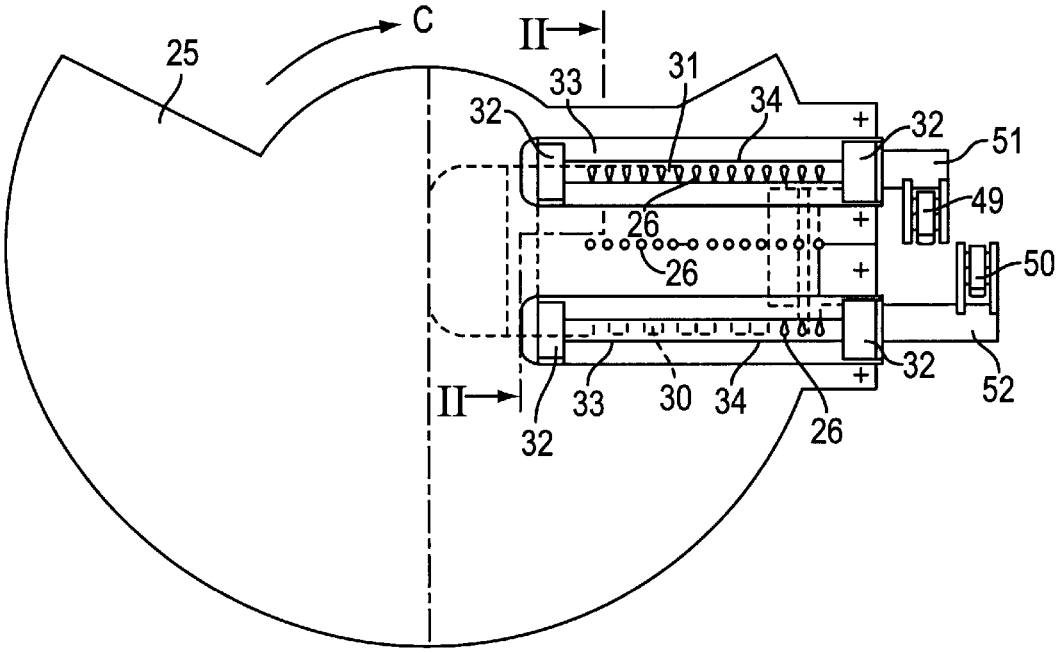
FIG. 3 A view from above of the counter opening disk of the opener, along the line I—I in FIG. 1.
Figure 6:
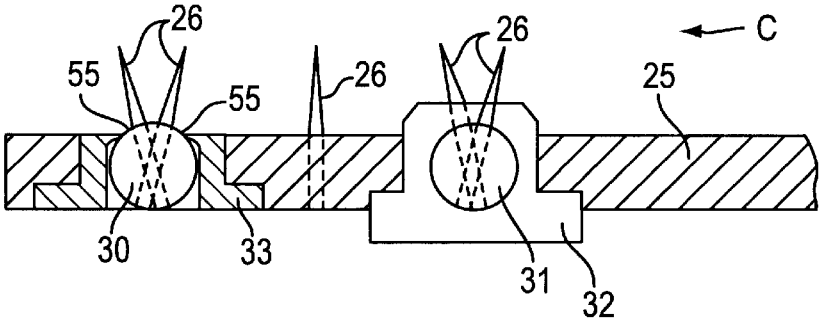
FIG. 6 A partial sectional view along the line II—II according to FIG. 3.

The circular segment-shaped counter opening disk 25 according to FIG. 3 is provided with two shafts 30 and 31, extending parallel to each other and parallel to the diameter of counter opening disk 25, which shafts are fitted with the pointed spikes 26. These shafts 30 and 31 are respectively positioned in bearings 32, which themselves are secured in inserts 33, as follows in particular from FIG. 6. These inserts 33 are fitted into cutouts 34 in the counter opening disk 25. Owing to the bearings 32, the shafts 30 and 31, which support the spikes 26, are mounted on the counter opening disk 25 such that they can tilt. Between the shafts 30 and 31 that support the rows of spikes 26, a parallel-extending row of spikes 26 is arranged, wherein these spikes 26 are fixedly inserted in the counter opening disk 25.

Figure 7:
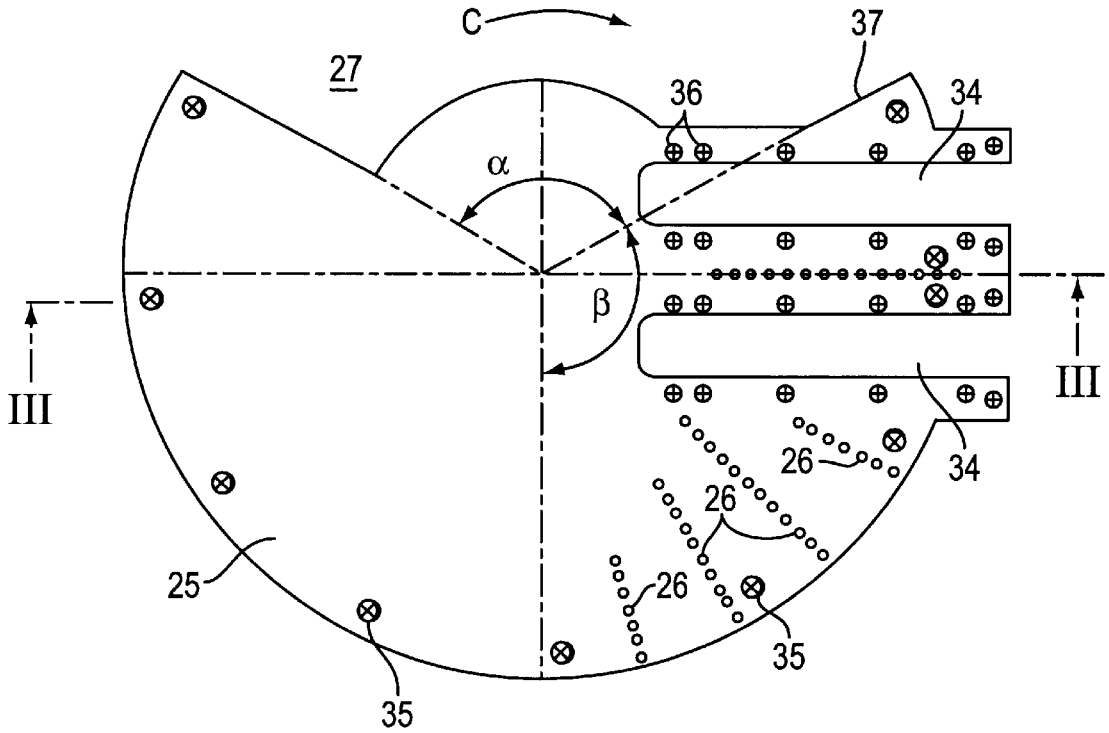
FIG. 7 A view from above of the counter opening disk according to FIG. 3, prior to assembly.
Figure 8:
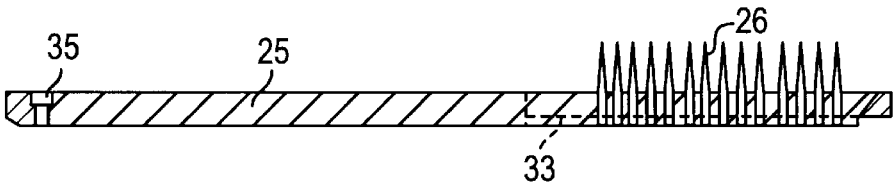
FIG. 8 A sectional view along the line III—III according to FIG. 7.

In accordance with FIG. 7, the counter opening disk 25, provided with fastening holes 35 distributed over its outer circumference, has further rows of spikes 26, which extend essentially radial to the outside circumference of the counter opening disk 25. The fastening holes 36 for the respective insert 33 for shafts 30 and 31 are visible in this figure as well. The circular segment-shaped cutout 27 in the counter opening disk 25 furthermore has a guide surface 37 for diverting the fiber material to the rows of spikes 26. The movement direction of the flaky fiber material is in rotational direction of the opening disk 16 and is shown with the arrow C.

Figure 4:
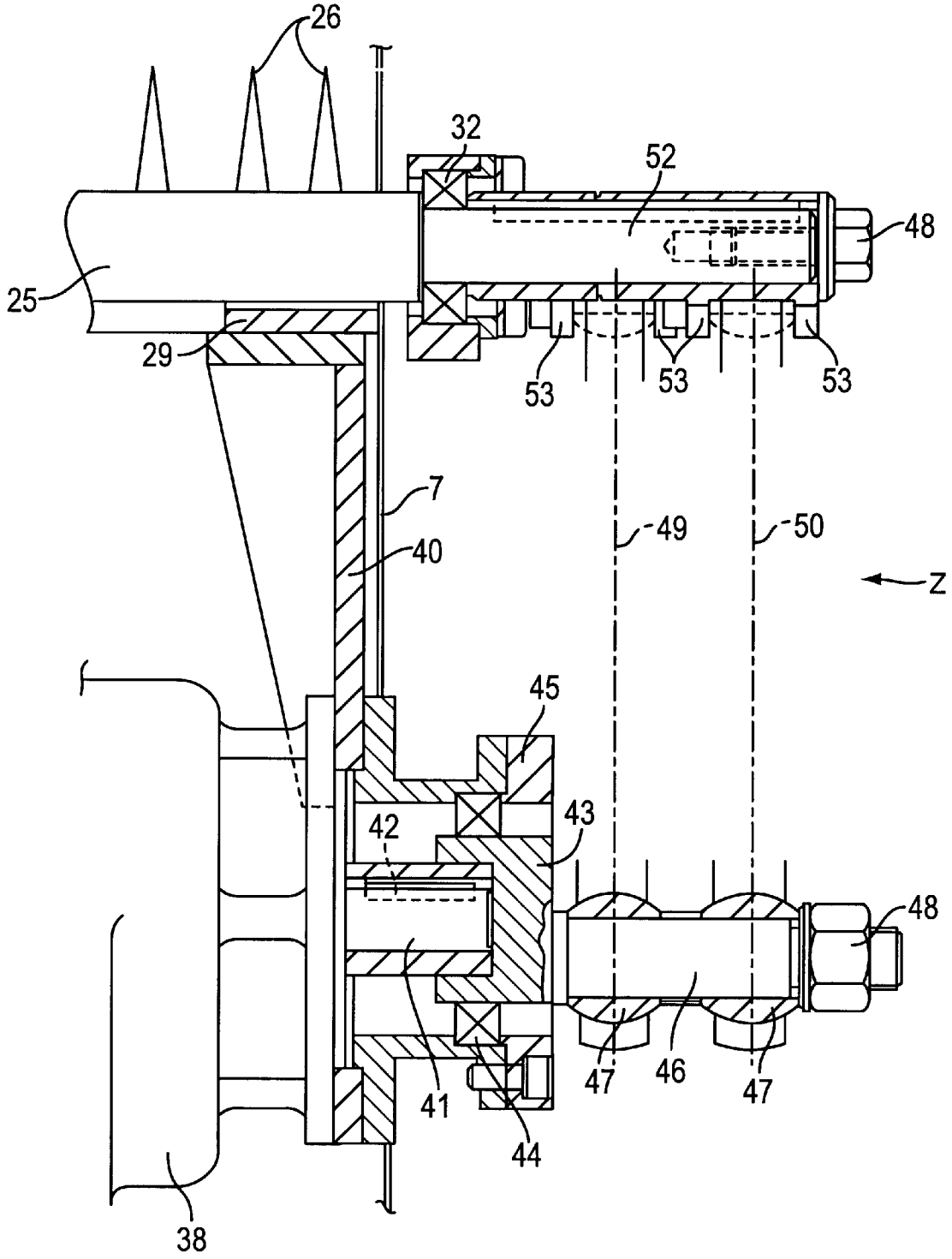
FIG. 4 An enlarged sectional view of the detail "Y" according to FIG. 2.

In the embodiments according to FIGS. 1 to 8, the shafts 30 and 31, which are fitted with rows of spikes 26, are placed into a rotating motion by a crank mechanism 39 that is operated by a drive motor 38. The crank mechanism 39, described in detail in the following, is shown in FIG. 4.

The drive motor 38 is mounted in a suitable way with an angle flange 40 on the hollow cylinder 7. The motor shaft 41 is connected to an eccentric cam 43 by means of a slot and feather connection 42. The eccentric cam 43 is secured such that it can rotate in a bearing 44 and is surrounded by a cover flange 45. Projecting from the eccentric cam 43 is an eccentric pin 46, on which two drive rods 49 and 50 are mounted by way of respective bearing eyes 47, which are attached with a clamping screw 48 to the eccentric pin 46. In accordance with FIG. 3, the drive rod 49 is used to move the rear shaft 31 that is provided with spikes, and the drive rod 50 is used to move the front shaft 30 that is provided with spikes in the counter opening disk 25. The drive shafts 49 and 50 are respectively connected with their upper ends to the shaft journals 51 and 52 of the shafts 30 and 31, meaning they have joint bars 53 in-between, which are secured with the aid of additional clamping screws 48. The length of piston rods 49 and 50 can be adjusted to the respective conditions with an adjustable screw coupling 54.

Figure 5:
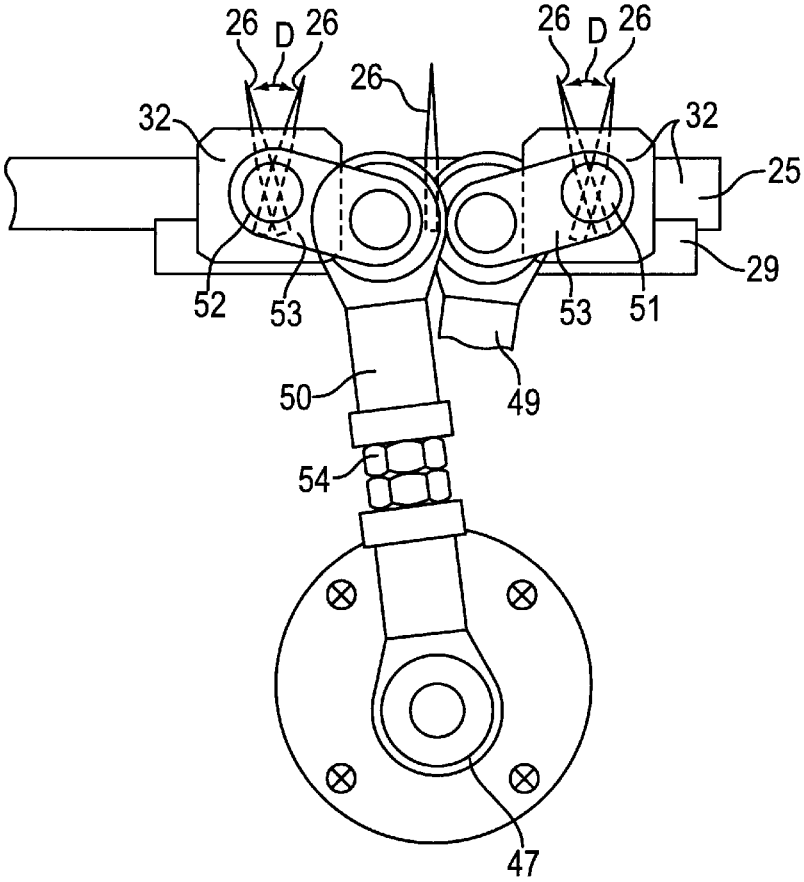
FIG. 5 A view in the direction of arrow "Z" in FIG. 4.

The double arrows D in FIG. 5 indicate the movement direction of the rows of spikes 26, for which the angle can be adjusted back and forth continuously with the aid of crank mechanism 39. The rows of spikes 26 move in counter direction toward each other or away from each other. As a result of this pendulum movement, the flaky fiber material cannot get snagged and cannot form laps on the spikes 26 since these laps are stripped off by the following fiber goods and the surrounding air flow, owing to the varied positions of the spikes 26 during the angle adjustment. This movement in counter direction of the two rows of spikes 26 is clearly visible in FIG. 6. Said figure also shows a lip seal 55, installed at the insert 33, which seals the respectively associated shaft 30 or 31 for the rows of spikes 26 against the space between the opening disk 16 and the counter opening disk 25.

Figure 9:
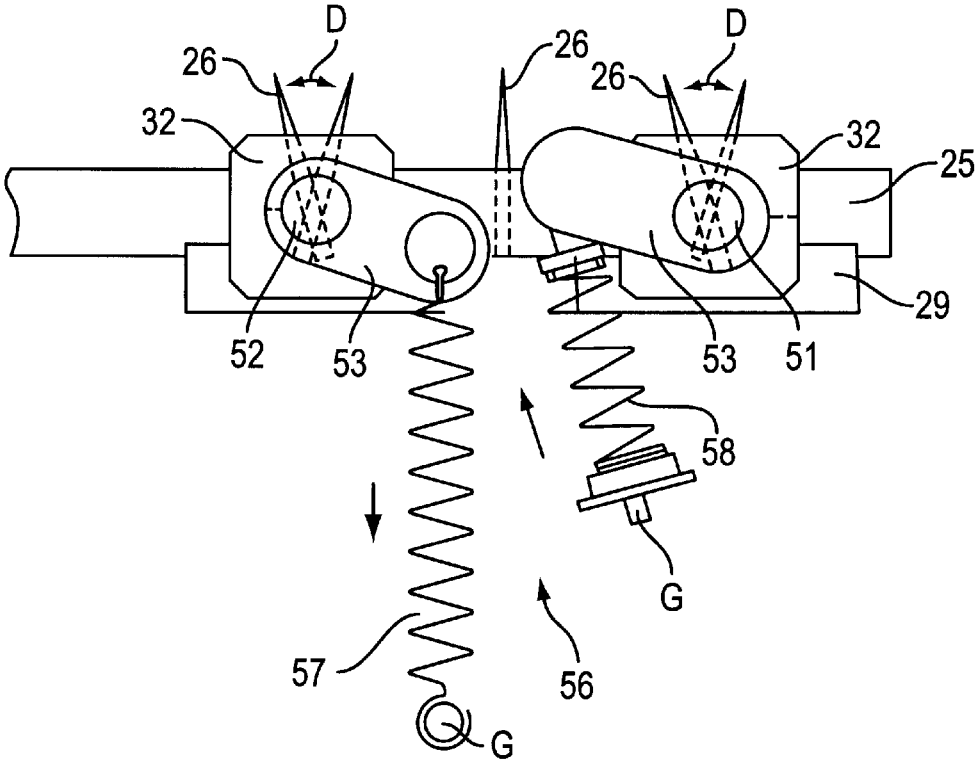
FIG. 9 A partial view from the side of the counter opening disk of an alternative opener according to the invention.
Figure 10:
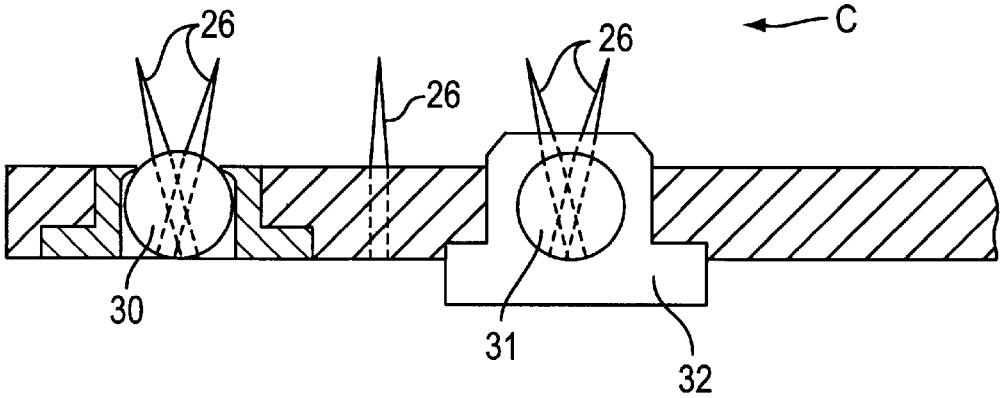
FIG. 10 A partial sectional view along the line II—II in FIG. 3, for an illustration according to FIG. 9.

In the embodiment of opener 1 that is shown in FIGS. 9 and 10, the shafts 30 and 31, fitted with spikes 26, are respectively acted upon by a spring 56, that is in such a way that the spikes 26 are positioned at an angle in rotational direction of the opening disk 16. A tension spring 57 is provided for shaft 30, which is arranged fixedly on a frame and at a point G, while for the shaft 31 a compression spring 58 is provided at a fixed point G on a frame. The springs 57 and 58 are pushed counter to their spring force by the fibers of the flaky fiber material flowing in the direction of arrow C onto the spikes 26, wherein the spikes 26 of the respective shaft 30 or 31 are moved as well. If the spikes 26 of the respective shaft 30 or 31 pass their vertex, the fibers attached to them are stripped off and the starting position, owing starting position, owing to the respective force of their associated springs 57 or 58. In accordance with FIG. 9, this results in a reciprocating movement in the direction of arrows D.

Figure 11:
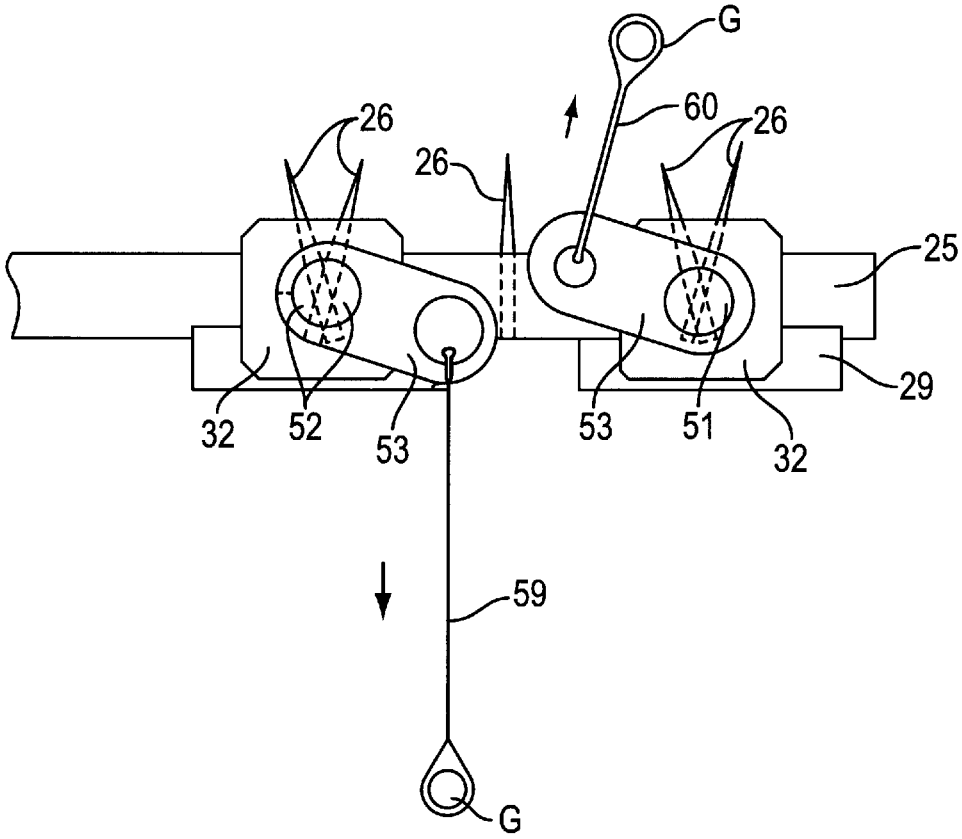
FIG. 11 An alternative embodiment of the illustration according to FIG. 9.
Figure 12:
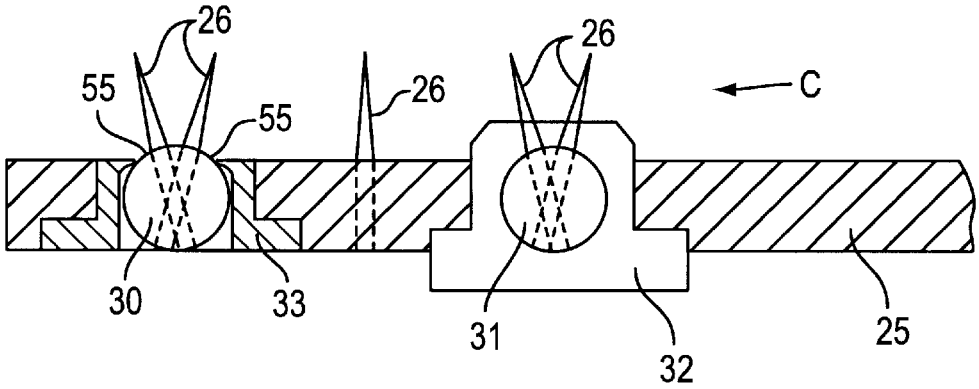
FIG. 12 A partial sectional view along the line II—II in FIG. 3, for an illustration according to FIG. 11.

FIGS. 11 and 12 illustrate an alternative embodiment of the representation according to the FIGS. 9 and 10, in which the springs 57, 58 are replaced by elastic strips 59 and 60, which are attached fixedly to a frame at respective points G. The resulting effect is the same as for the embodiment described in the above.

Figure 13:
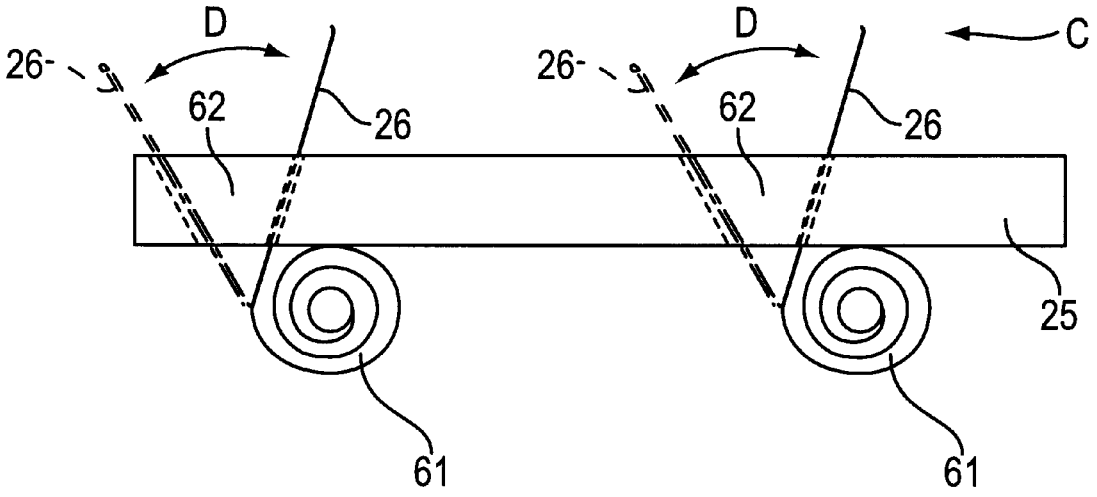
FIG. 13 A partial view from the side of the counter opening disk of an additional alternative opener according to the invention.

In the embodiment of opener 1 as shown in FIG. 13, the adjustment of the angle for spikes 26 is realized with spiral springs 61, which are arranged below the counter opening disk 25. Each of these spiral springs 61 is designed as a spike 26 on its free, front end, which can be moved back and forth inside a V-shaped opening 62 in the counter opening disk 25. The starting position for these spikes 26 is again at an angle, in rotational direction of the opening disk 16. The operational principle in this case is the same as that for the previously described shafts 30, 31 with spikes 26, which are admitted by a spring force.

What is claimed is:

1. An opener for opening flaky fiber material comprising:

a driven opening disk having a first side and a second side and which rotates in a direction;

a first plurality of spikes mounted on the first side of said opening disk;

a counter opening disk having a circumference, a first side facing the opening disc and a second side, fixedly mounted parallel and opposite to the first side of the opening disk;

a second plurality of spikes mounted on the first side of the counter opening disk and fitted so as to tilt at an angle in a direction of the opening disk and arranged substantially radially in rows; and a drive mechanism for moving the angle of at least one row of the spikes on the counter opening disk back and forth in rotational direction and counter to the rotational direction of the opening disk.

2. The opener according to claim 1, wherein the counter opening disk has a circular-segment design with a circular segment shaped cutout, and a first row of the spikes on the counter opening disk is located closely behind the circular-segment shaped cutout in the direction of rotation of the opening disc and substantially perpendicular to the direction of rotation.

3. The opener according to claim 2, wherein the circular-segment shaped cutout in the counter opening disk is defined by a circumferential angle of approximately 120°.

4. The opener according to claim 1, wherein a plurality of the rows of spikes mounted on the counter opening disc, include a number of spikes essentially equally spaced along the rows and said rows extend essentially radially inward from the circumference of the counter opening disk and wherein the number of spikes in successive rows are progressively reduced such that the rows become progressively shorter in the radially inward direction around the counter opening disc in the rotational direction of the opening disk.

5. The opener according to claim 1, further including two rows of spikes mounted on the counter rotating disk and extending substantially parallel and side-by-side, and wherein said substantially parallel two rows of spikes are mounted such that the angle of the spikes can be moved back and forth, in counter direction to each other.

6. The opener according to claim 5, wherein at least one row of fixedly attached spikes is arranged between neighboring, parallel and side-by-side extending rows of spikes, for which the angle can be adjusted back and forth.

7. The opener according to claim 6, wherein the spikes of the fixedly attached row of spikes of the counter opening disk are installed such they are tilted in rotational direction of the opening disk.

8. The opener according to claim 1, wherein the spikes for which the angle can be adjusted, are fastened on at least one rotatable shaft.

9. The opener according to claim 1, wherein the counter opening disk is provided with spikes only within an angular region of approximately 120°.

10. The opener according to claim 1, wherein at least each one of the rows with spikes, for which the angle can be adjusted back and forth, is fastened with an insert fitted into a corresponding cutout in the counter opening disk.

11. The opener according to claim 10, wherein the insert further comprises:

a rotatable shaft on which is mounted the row of spikes; and a lip seal in a direction of the opening disk, which seals the shaft provided with the spikes (26) to substantially prevent the exit of fibrous material between the opening disk and the counter opening disk.

12. The opener according to claim 1, wherein the spikes have sharp points.

13. The opener according to claim 1, wherein the rows of spikes, for which the angle can be adjusted back and forth, can be actuated via a motor-driven crank drive.

14. The opener according to claim 13, wherein the crank drive mechanism has one or more eccentric cams, which transmits the motor drive movement onto one or more respective crank shafts.

15. The opener according to claim 13, wherein the motor of the crank drive is one of an electric motor, a pneumatic motor, and a hydraulic motor.

16. The opener according to claim 1, wherein at least one row of the spikes on the counter opening disk is positioned such that the angle can be adjusted in rotational direction and counter to the rotational direction of the opening disk, wherein a spring force acts upon the spikes in rotational direction of the opening disk.

17. The opener according to claim 16, wherein at least one of a tension spring and a compression spring is associated with each row of spikes, for which the angle can be adjusted.

18. The opener according to claim 17, wherein the spring(s) are one of a steel spring and a rubber spring.

19. The opener according to claim 1, wherein at least one spike of the counter opening disk is held at an angle in counter-rotational direction of the opening disk through the force of a spring.

20. The opener according to claim 19, wherein for at least one row of spikes on the counter opening disk, each spike is formed by the free front end of a spiral spring, wherein the angle of each spike is movable in rotational direction and counter to the rotational direction of the opening disk and wherein when the spiral spring is in its relaxed position each spike is held by the force of a spring such that it tilts in the counter-rotational direction of the opening disk.

* * * * *